United States Patent [19]

Hård af Segerstad

[11] 4,271,560

[45] Jun. 9, 1981

[54] ARRANGEMENT FOR ATTACHING, FOLDING AND SLIDABLE SUSPENSION OF CURTAINS, DRAPERIES AND THE LIKE AT A CURTAIN ROD

[76] Inventor: Göran J. F. Hård af Segerstad, Borgmästarvägen 4, S-19030 Sigtuna, Sweden

[21] Appl. No.: 949,690

[22] Filed: Oct. 10, 1978

[30] Foreign Application Priority Data

Oct. 7, 1977 [SE] Sweden ..... 7711309

[51] Int. Cl.[3] ..... A47N 15/00

[52] U.S. Cl. ..... 16/93 D

[58] Field of Search ..... 16/93 R, 93 D, 95 D, 16/95; 160/345, 126

[56] References Cited

U.S. PATENT DOCUMENTS 2,872,696 2/1959 Perlmutter ..... 16/93 D

FOREIGN PATENT DOCUMENTS 1084668 9/1967 United Kingdom ..... 16/93 D

*Primary Examiner*—Doris L. Troutman

*Attorney, Agent, or Firm*—Holman & Stern

[57] ABSTRACT

A curtain suspension device including a curtain clasp which is mounted in the slot of a curtain rod which curtain clasp comprises a needle slide member consisting of an oblong mirror-symmetrical plate provided at one of its longitudinal faces with a projection which is T-shaped in cross section and extends along the entire length of the oblong slide member in the symmetry plane thereof to form a slide shoe for sliding movement in the slot of the curtain rod, with the flanges of the "T" acting as guides in the slot. The slide member is provided, at the opposite one of its longitudinal faces, with a pair of projecting studs each of which has a slot open at right angles from the free end and aligned in the symmetry plane of the slide member to receive a curtain-carrying pin the head of which is pivotally engaged in a cavity in the bottom of the slot of one of said studs, and the tip of which pin is adapted to engage the slot in the other stud, which slot is also widened at its bottom in order to lock the needle whichever position the slide member in the slot of the curtain rod may take.

2 Claims, 5 Drawing Figures

ARRANGEMENT FOR ATTACHING, FOLDING AND SLIDABLE SUSPENSION OF CURTAINS, DRAPERIES AND THE LIKE AT A CURTAIN ROD

BRIEF SUMMARY OF THE IVENTION

The present invention relates to an arrangement for attaching, folding and slidable suspension of curtains, draperies and the like at a curtain rod.

In British Pat. No. 1,084,668 there is described a curtain clasp for draping and hanging curtains, said curtain clasp consisting of an oblong body provided with a pin adapted to be pierced through the hem of a curtain. According to the patent, the clasp body comprises a plate member which is provided at one of its longitudinal sides with at least one mushroom-like projection having a neck portion and an enlarged portion adapted to be introduced into and slidably carried by the slot of a curtain rod, and which is provided at the other longitudinal side opposite to the first longitudinal side with two perpendicularly extending substantially cylindrical studs in spaced relation, one of which carries a pivotally secured pin and the other is provided with a slot extending essentially at right angles to the axial direction of the stud and adapted to receive the tip of the pin. Preferably, said oblong plate is provided with two mushroom-like projections, and is made from a hard plastic such as nylon.

Although the above curtain clasp has operated satisfactorily, it still suffers from some drawbacks which are not unessential. The mushroom-like projection adapted to guide the clasp has shown a tendency of jamming in the slot when small irregularities are present therein. This disadvantage will be remedied to some extend by providing the curtain clasp with two mushroom-ike projections, one at each end of the oblong body of the clasp so as to render it possible for it to slide better in the slot of the curtain rod. Although the slidability of the curtain clasp will be improved through the two-point suspension thus obtained, it has been found, however, that the slidability still left a great deal to be desired.

Another disadvantage of the curtain clasp described relates to the locking of the tip of the pin in the transversal slot in the tip-receiving stud of the curtain clasp. In order to carry the curtain pin in a reliable manner, the pin must rest on the bottom of the slot. This presupposes that thecurtain clasp initially must be slipped into the slot of the curtain rod with the transversal slot facing upwards since, otherwise, under the weight of the curtain, the pin would open and drop the curtain.

Therefore, in view of these problems associated with the prior curtain clasp, it is an object of the present invention to provide a curtain suspension device having an improved curtain clasp which affords an increased slidability in the slot of a curtain rod.

It is also an object of the invention to provide a curtain clasp which ensures a safe locking action on a curtain suspended on its pin whichever position the curtain clasp may take in the slot of the curtain rod.

In accordance with the present invention an arrangement for attaching, folding and slidable suspension of curtains, draperies and the like at a curtain rod is provided, said arrangement comprising a curtain clasp having a needle slide member and means cooperating therewith to allow slidable movement of the needle slide member in a slot of a curtain rod, said needle slide member consisting of an oblong mirror-symmetrical plate which is provided at one of its longitudinal faces with means for maintaining and guiding the slide member in the slot of the curtain rod, and at the other of its longitudinal faces with a pair of projecting studs with open slots at the end faces adapted to receive a curtain suspension pin bridging over the studs.

According to the invention, said means for maintaining and guiding the slide member in the slot of a curtain rod comprises a projection T-shaped in cross section extending along the entire longitudinal side of the slide member, with the web of the "T" extending transversely outwards from the longitudinal side of the slide member in the symmetry plane thereof, to form a slide shoe for moving the slide member along the slot of the curtain rod, and with the flanges of the "T" acting as guides for the slide member during its displacement.

BRIEF DESCRIPTION OF THE DRAWINGS

The invention is illustrated in the accompanying drawings wherein.

DETAILED DESCRIPTION

Figure 1:
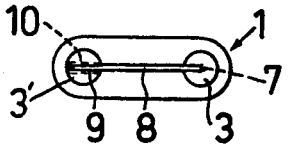
FIG. 1 is a front elevation view of a curtain clasp according to the invention.
Figure 3:
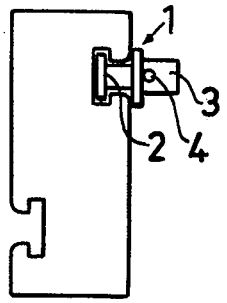
FIG. 3 is a side view of the curtain clasp inserted into a slot of a curtain rod.
Figure 2:
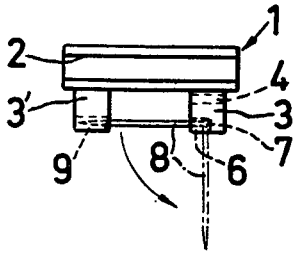
FIG. 2 is a top plan view of the curtain clasp in FIG. 1.
Figure 4:
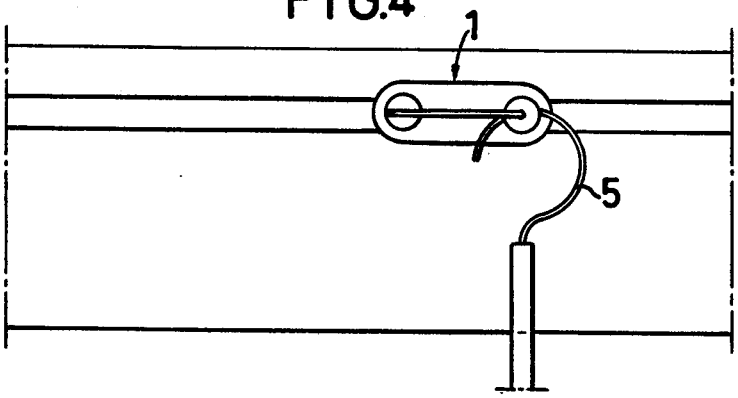
FIG. 4 is a front elevation view showing the curtain clasp introduced into the slot of the curtain rod and with a drawhook connected to the clasp.
Figure 5:
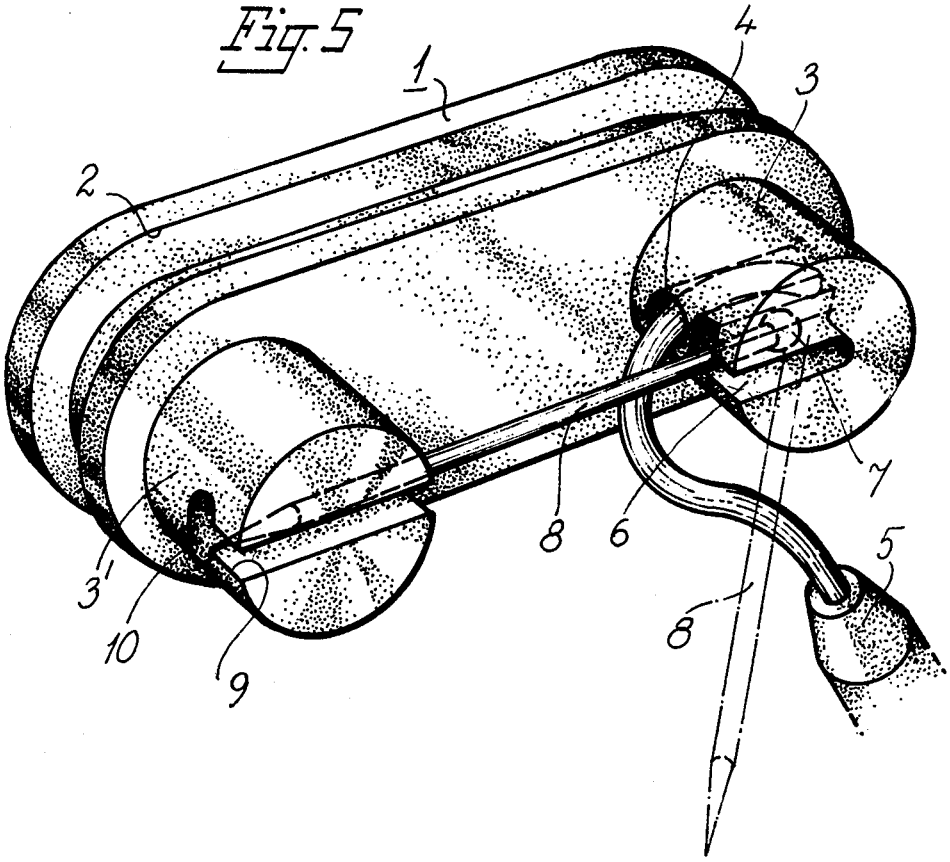
FIG. 5 is a perspective view at an enlarged scale of a curtain clasp according to the invention.

With reference to FIGS. 1, 2 and 5 the main component of the draping arrangement according to the present invention is a curtain clasp including an oblong slide member 1 made from a rigid although somewhat elastic material such as Nylon. For maintaining and guiding in the slot of a curtain rod, the slide member is provided, along the entire longitudinal side, with a T-shaped projection 2 for guiding in the slot of the curtain rod. The opposite longitudinal side of the slide member 1 is provided at each end with one projecting stud 3 and 3', respectively. One stud 3 is provided near its base with a through hole 4 extending in the longitudinal direction of the slide member 1, said hole forming an attachment for a drawhook 5 extending around about ¾ of a circle and being freely movable in many directions, said drawhook affording from a vector point of view an excellent cooperation with a slide member fastened to an upper corner of the curtain. Furthermore, the stud 3 is provided with a horizontal quarter-quadratic slot 6 open from the front and medially. In this slot there is also provided branched channels forming a channel system in the shape of a "T", the diameter of said channels being chosen so as to render it possible to resiliently anchor a pin-head in the stud 3. The pin 8 is urged into the open slot channel until the pin head 7 reaches the bottom of the channel where the movement is restricted by the transverse branch channels of the "T". This meeting of the T-shaped channel system becomes an anchoring point of the pin head 7 located approximately in the center of the stud. Thus, the pin 8 will form a resilient ball joint bearing in the stud so that it may be turned outwards and inwards by an angle of 90° with resilient frictional resistance with extreme positions governed by the quarter-slot channel. In the maximal turned-out position the pin is directed in the extension of the stud 3 so that, with the slide member as a handle, it may easily be stuck through a curtain and then turned inwards along the slide member. In order to provide an effective anchoring and locking of the free pin tip in the other stud 3', this stud is also provided with a slot 9 extending in the longitudinal direction of the slide member and branched at its bottom in the same manner as the T-shaped channel system described and shown with reference to stud 3. As an alternative, from an easy manufacturing point of view, the slot of stud 3' may be widened at its bottom in the shape of a circular through hole having a diameter which is larger than the width of the slot 9 (not shown). By any one of this arrangements the curtain-carrying pin will be locked in position by the weight of the curtain so that it cannot be released from its engagement in the slot by careless drawing of the curtain, whichever position the slide member may take in the slot of the curtain rod. As soon as the pin is released from the weight of the curtain, it can easily be rotated outwards for removal of the curtain.

Although the invention is described in detail in respect to the example and the individual drawings, it will be clear that modifications in materials and structure can be made by those skilled in the art within the scope of the invention as defined in the appended claims.

What I claim is:

1. In a curtain clasp for attaching, folding and slidable suspension of curtains, draperies and the like at a curtain rod, having a needle slide member and means cooperating therewith to allow slidable movement of the needle slide member in a slot of a curtain rod, said needle slide member consisting of an oblong mirror-symmetrical plate provided at one of its longitudinal faces with means for maintaining and guiding the slide member in the slot of the curtain rod, and at the other of its longitudinal faces with a pair or projecting studs with open slots at the ends adapted to receive a curtain suspension pin bridging over the studs, the improvement comprising said means for maintaining and guiding the slide member in the slot of a curtain rod being a projection T-shaped in cross-section and extending along the entire longitudinal side of the slide member in the symmetry plane thereof to form a slide shoe for moving the slide member along the slot of the curtain rod with the flanges of the "T" acting as guides for the slide member during its displacement, and one of said pair of projecting studs is provided with a quarter-quadratic slot open both at right angles outward from the free end of the stud and in a direction towards the other of said pair of studs, said slot of said one stud being aligned with the symmetry plane of the slide member, and the bottom of which being located approximately at the center of the stud and branched to form a T-shaped channel system, the width of the stem and branch channels of which being chosen with respect to the curtain suspension pin so as to allow the pin with its head to be urged downwards through the open channel into pivotal engagement with the stud in the meeting point of the stem channel and its branch channels in the center of the stud; and wherein the other of said pair of projecting studs is provided with a slot extending diametrically through the stud along the symmetry plane thereof, said slot having at its bottom a widened hole extending in the longitudinal direction of the slide member and adapted to support and maintain the tip of the pin under the weight of the curtain.

2. A curtain clasp as claimed in claim 1, wherein at least one of said studs of the slide member is provided with a diametrical through hole extending in the symmetry plane of the slide member and adapted to cooperate with a draw-rod having a circular hook threaded through the hole to act as a displacement means.

* * * * *